US010803703B2

(12) United States Patent
Grubmueller, Jr.

(10) Patent No.: US 10,803,703 B2
(45) Date of Patent: Oct. 13, 2020

(54) GAMING SYSTEM

(71) Applicant: Walter Grubmueller, Jr., Vienna (AT)

(72) Inventor: Walter Grubmueller, Jr., Vienna (AT)

(73) Assignee: Walter Grubmueller, Vienna (AT)

( * ) Notice: Subject to any disclaimer, the term of this patent is extended or adjusted under 35 U.S.C. 154(b) by 863 days.

(21) Appl. No.: 14/895,736

(22) PCT Filed: Jun. 5, 2014

(86) PCT No.: PCT/EP2014/061718
§ 371 (c)(1),
(2) Date: Dec. 3, 2015

(87) PCT Pub. No.: WO2014/195414
PCT Pub. Date: Dec. 11, 2014

(65) Prior Publication Data

US 2016/0125686 A1 May 5, 2016

Related U.S. Application Data

(60) Provisional application No. 61/831,829, filed on Jun. 6, 2013.

(30) Foreign Application Priority Data

Mar. 4, 2014 (EP) ..... 14157712

(51) Int. Cl.
*G07F 17/32* (2006.01)
*G07F 17/34* (2006.01)

(52) U.S. Cl.
CPC ..... *G07F 17/322* (2013.01); *G07F 17/32* (2013.01); *G07F 17/3209* (2013.01);
(Continued)

(58) Field of Classification Search
CPC .... G07F 17/322; G07F 17/32; G07F 17/3209; G07F 17/3272; G07F 17/34; G07F 17/3223; G07F 17/3288
See application file for complete search history.

(56) References Cited

U.S. PATENT DOCUMENTS

2008/0248846 A1* 10/2008 Stronach ..... G07F 17/32 463/6
2009/0176548 A1 7/2009 Nakamura
2013/0059638 A1* 3/2013 Nicely ..... G07F 17/322 463/17

FOREIGN PATENT DOCUMENTS

EP 2 551 829 A2 1/2013

OTHER PUBLICATIONS

Wheel of fortune wiki of gameplay elements, pp. 4-5, 10. various dates of Sep. 15, 1986, Sep. 8, 2008, Sep. 2, 2002.*
(Continued)

*Primary Examiner* — Kang Hu
*Assistant Examiner* — Thomas H Henry
(74) *Attorney, Agent, or Firm* — Dickinson Wright PLLC

(57) ABSTRACT

A method of playing a modified electronic version of roulette includes providing an executable instruction set hosted on a gaming system having a central server system, a random number generator, a database connected to an electronic network and at least one display for presenting to a player a representation of a roulette wheel, a roulette betting table, and a bet acceptance display for placing bets. A player's bet is placed, and a random number is selected and associated to one of a field of numbers on the betting table representation as the winning number. The winning and losing bets are determined and the winning number is removed from the field of numbers on the betting table. The removed number is replaced with a randomly selected one of
(Continued)

the numbers remaining in the field of numbers on the table and the odds of each possible bet are recalculated.

13 Claims, 6 Drawing Sheets

(52) U.S. Cl.
CPC ..... *G07F 17/3223* (2013.01); *G07F 17/3272* (2013.01); *G07F 17/3288* (2013.01); *G07F 17/34* (2013.01)

(56) References Cited

OTHER PUBLICATIONS

Anonymous: "Ruletas Digitales: Productos: Club Royal: Maquinas y Software para Casinos", Apr. 10, 2012, XP055118645, Retrieved from the Internet: URL:http://web.archive.org/web/20120410084822/http://www.clubroyal.com.ar/productos_ruletas_diaitales.php, retrieved on May 19, 2014, the whole document.
Anonymous: "Roulette Glossary, Terminology, Jargon, Slang, Vocabulary", Jan. 2, 2012, XP055116893, Retrieved from the Internet: URL:http://web.archive.org/web/20120102212743/http://www.ildado.com/roulette-glossary.html, retrieved on May 8, 2014, p. 2.

* cited by examiner

GAMING SYSTEM

FIELD OF THE INVENTION

The present disclosure generally relates to apparatuses and methods for playing games of chance. More particularly, the present disclosure relates to a system and method for playing an electronic variation of roulette.

BACKGROUND OF THE INVENTION

The game of roulette was initially devised in eighteenth century France and has been played in its present form for a little more than two hundred years. Roulette is a casino game where players may choose to place bets on either a single number or a range of numbers, the colors red or black, or whether the number is odd or even. To determine the winning number and color, a croupier spins a wheel in one direction, then spins a ball in the opposite direction around a tilted circular track running around the circumference of the wheel. Eventually, the ball loses momentum and falls onto the wheel and into colored and numbered pockets on the wheel. In French or European roulette there are 37 pockets on the wheel, and in American roulette the wheel has 38 pockets. The pockets are numbered 1-36 with each number being associated with either the color red or the color black. The extra pockets are typically green and are identified with a zero for the French wheel or with a zero and a double zero for the American wheel to complete the labeling of the pockets.

The numbers are also labeled on the surface of a table associated with the wheel in corresponding colored blocks in a standardized pattern known in the industry. Roulette players have a variety of betting options. Placing inside bets is either selecting the exact number of the pocket the ball will land in, or a small range of pockets based on their proximity on the table layout. Players wishing to bet on the 'outside' will select bets on larger positional groupings of pockets, the pocket color, or whether the winning number is odd or even. The payout odds for each type of bet are based on the mathematical probability of the occurrence coming to fruition.

The roulette table usually imposes minimum and maximum bets, and these rules usually apply separately for all of a player's inside and outside bets for each spin of the wheel. For inside bets at the table, some casinos may use separate roulette table chips of various colors to distinguish players at the table. Players con continue to place bets as the ball spins around the wheel until the dealer announces, "No more bets."

When a winning number and color is determined by the roulette wheel, the dealer will place a marker on that winning number on the roulette table layout. When the marker is on the table, no player may place a bet, collect a bet or remove any bets from the table. The dealer will then sweep away all other losing bets either by hand or by using a rake, and determine all of the payouts to the remaining inside and outside winning bets. When the dealer has finished making payouts, the marker is removed from the board whereupon plays may then collect their winnings and make new bets. The winning chips remain on the board.

The house edge with respect to betting is found in the green zero and double zero. Since other than an inside bet on the number as the winning number, there are no outside bets related to either of the green slots. Outside bets will always lose when a single or double zero is the winning number. However, the house also has an edge on inside bets because the payouts are always set at 35:1 when the mathematical odds of betting on a winning number are 1:37 or 1:38 depending on which wheel is being used.

While casino games originally relied on mechanical apparatuses, such as a dealer distributing decks of cards at a blackjack table, a player physically rolling a pair of dice at craps, or a dealer spinning the wheel at roulette, the electronic age has caught up with casino games. Electronic versions of these games utilize computer servers interconnected with clients such as display screens and touch sensitive screens for player interaction and electronic random number generators to randomize the occurrences upon which the players are betting. The house benefits from this modernization by reducing the number of staff required to monitor electronic play and most importantly by increasing the number of betting cycles per hour. The increased number of cycles is facilitated by the faster computerized collection and distribution of bets and winnings instead of a dealer addressing each bet individually.

Casino gaming is becoming more and more competitive since more and more governmental entities are approving gaming within their boundaries as a legal activity, albeit controlled. For example, in the United States gaming has expanded from what was traditionally the sole purview of one state (Nevada) to the present where casinos can now be found in many states. Because of the ever increasing number of casinos available to the public, individual casinos must compete ever more intensely for patrons. One manner of competition is the introduction of new games or of variations of traditional casino games. However, these new or modified games typically require and significant investment in tables and unique apparatuses to play the game. Computerized gaming has greatly facilitated the introduction of new or modified games. Changes in software to the different gaming applications with the visible changes occurring on patron viewed displays are much more effective in cost and time than the purchase of physical tables and mechanical machines.

However, the physical game of roulette does not particularly lend itself to the establishment of new physical variations of the game beyond what has been practiced for centuries. Therefore, a computerized or electronic variation of the game of roulette is needed to present patrons with a variety of games to maintain interest and to improve the competition between casinos.

SUMMARY OF THE INVENTION

The present disclosure is generally directed to a method of playing a modified electronic version of roulette and includes providing an executable instruction set hosted on a gaming system having a central server system, a random number generator, a database connected to an electronic network and at least one display for presenting to a player a representation of a roulette wheel, a representation of a roulette betting table, and a bet acceptance display for the player to place bets. A player's bet is received from the bet acceptance display, and a random number is selected by the system and is associated to one of a field of numbers on the betting table representation as the winning number. The winning and losing bets are determined and the winning number is removed from the field of numbers on the betting table. The removed number is replaced with a randomly selected one of the numbers remaining in the field of numbers on the table and the odds of each possible bet are recalculated.

According to the present invention a method of playing a modified electronic version of roulette is provided, said method including the steps of:

providing an executable instruction set hosted on a system of the type wherein the central office of a gaming service company has a central server system, a random number generator, and a database connected to an electronic network and at least one display for presenting to a player a draw presentation for displaying a representation of a roulette wheel, a table presentation display for displaying a representation of a roulette betting table, and a bet acceptance display for the player to place bets;

receiving from the bet acceptance display a bet desired by the player;

selecting a random number and associating the random number to one of a field of numbers presented on the table presentation display;

designating the associated one of the field of numbers as the winning number; determining winning and losing bets;

removing the winning number from the field of numbers presented on the table presentation display;

replacing the removed number with a randomly selected one of the numbers remaining in the field of numbers presented on the table presentation display;

recalculating the odds of each possible bet; and repeating the betting cycle.

These and other features, aspects, and advantages of the invention will be further understood and appreciated by those skilled in the art by reference to the following written specification, claims and appended drawings. On aspect of the present invention concerns the "physical" roulette wheel which can be substituted by a random number generator to represent the result of a "spin" and the result in turn can be displayed on an electronic display, such as a computer display or a displayed roulette wheel. The random number generator can select a random number and can associate the random number to one of a field of numbers presented on the table presentation display, e.g. the random number may be displayed on a roulette wheel.

The random number generator can select the random numbers electronically via hardware and/or software implementation which allows the roulette wheel to be manually operated by a croupier and the result is (automatically) transmitted to the system or automatically via a real roulette wheel with a real roulette ball, wherein the insertion and the removal of the ball works fully automatic (e.g. with a pneumatic, mechanical or similar mechanism).

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
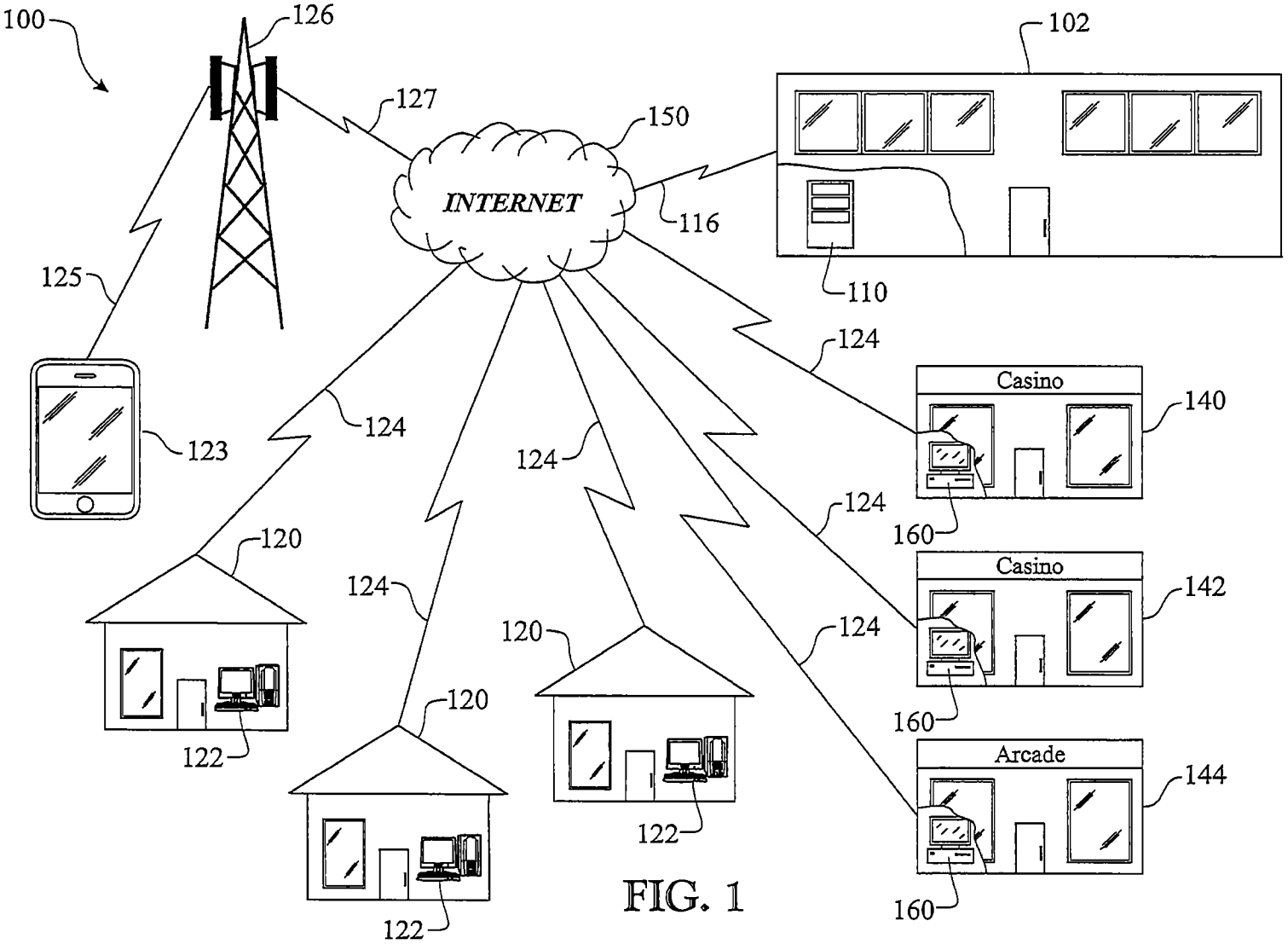
FIG. 1 presents a schematic depiction of a network based system for playing a modified electronic version of roulette.
Figure 2:
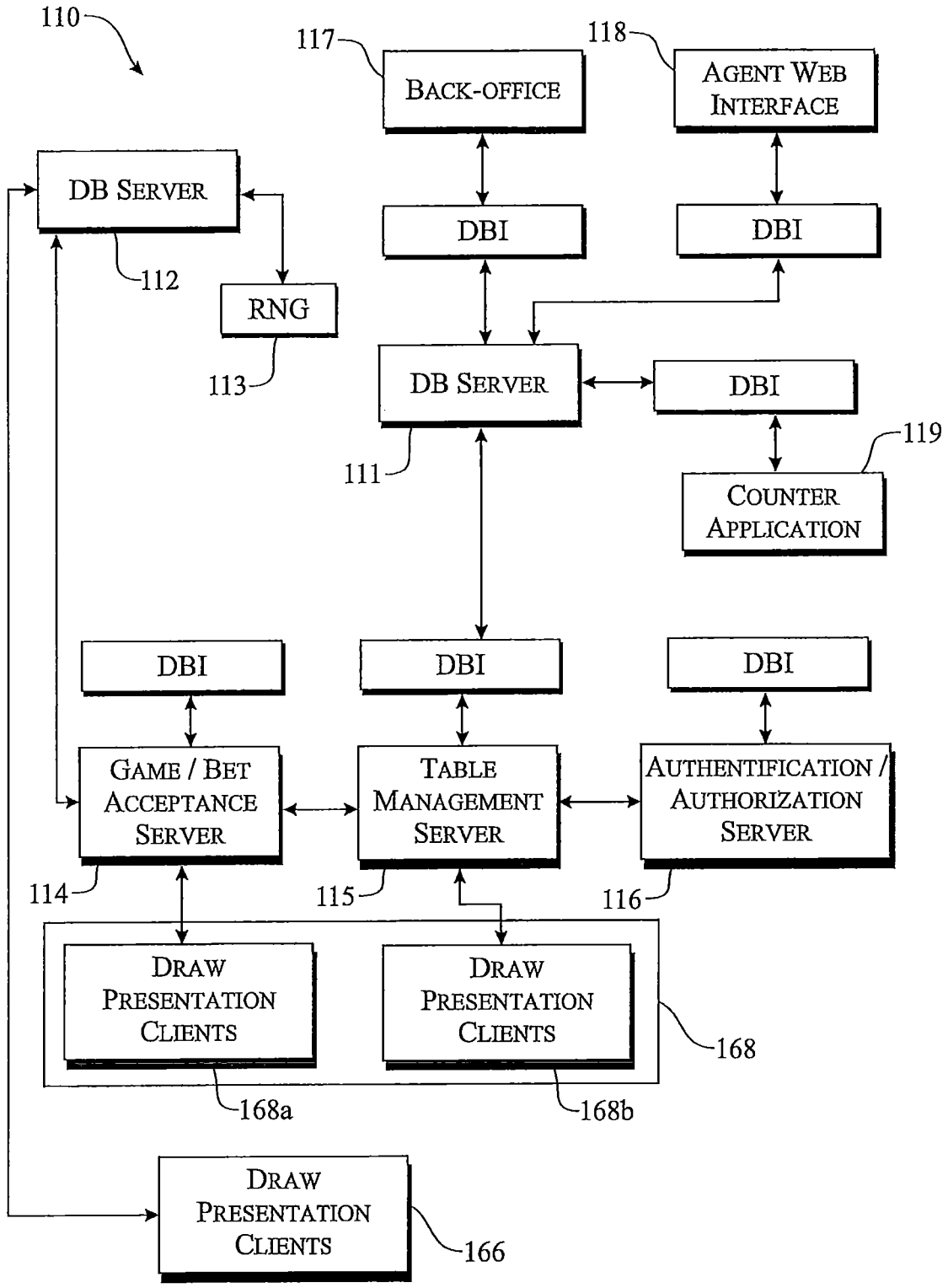
FIG. 2 presents a schematic depiction of the server network and inter-module communication for the system of FIG. 1.
Figure 3:
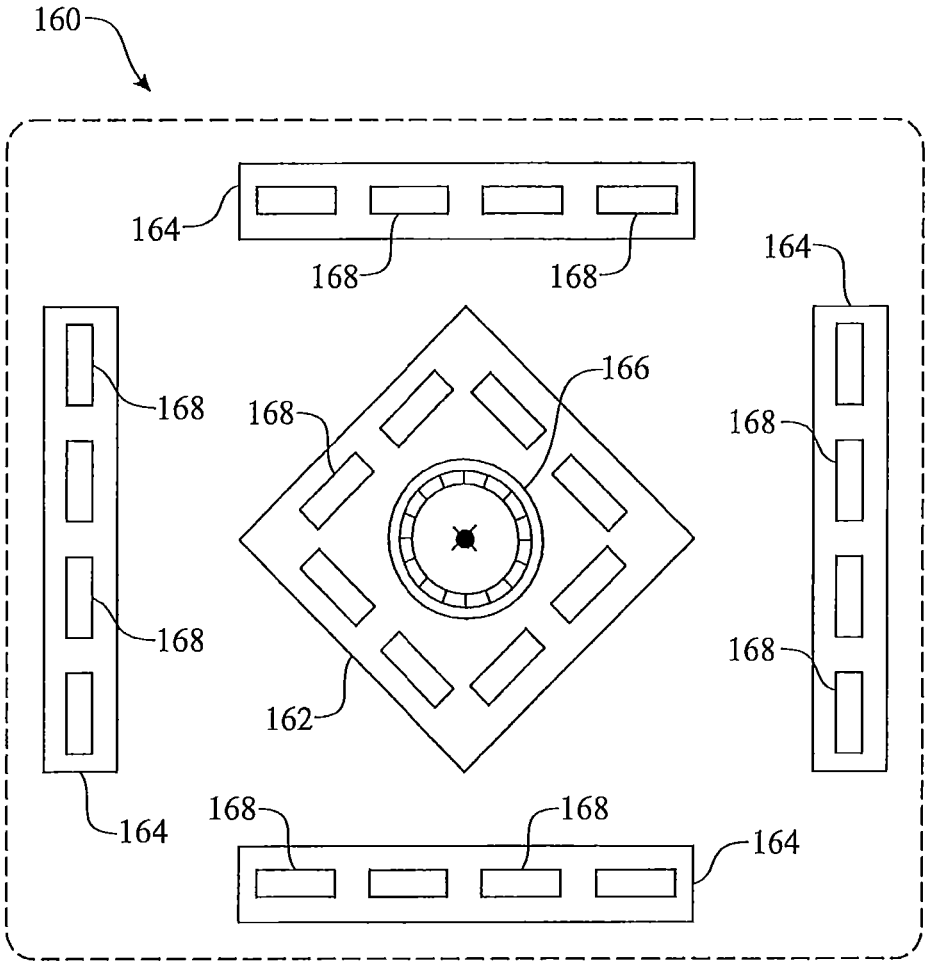
FIG. 3 presents a plan view layout of a gaming area in a casino for playing the modified electronic version of roulette.

In one exemplary implementation of the invention, a roulette betting system 100 for playing an electronic modified version of the game of roulette is shown in FIGS. 1-3 illustrating its various components. The system 100 is based on spins on a roulette wheel typically based on either a European wheel of thirty-seven numbers or an American wheel of thirty-eight numbers. However, wheels of more or fewer numbers are also possible. The physical roulette wheel can be substituted by a random number generator to represent the result of a "spin" and the result in turn can be displayed on an electronic display, such as a computer display. The roulette betting system 100 is based at a central office 102 of a gaming service wherein the gaming service central office 102 houses a central server system 110 executing an instruction set for playing the modified version of roulette. The server system 110 hosts an executable instruction set for playing the modified electronic version of roulette and is connected to the Internet 150 with a communications link 116 for communicating with entities outside of the central office 102.

The player/system interface generally comprises three elements. A bet acceptance client 168*a* (FIG. 2) is the interface element enabling the player to place bets on the system 100 using a touch screen computer or a software application which can be run on a computer 120, or a wireless device such as a personal electronic device 123, or a dedicated interface at a gaming station 160 in a casino 140, 142, or arcade 144. A table presentation client 168*b* provides the user with a graphical representation of the betting table.

The bet acceptance client 168*a* and the table presentation client 168*b* are typically a unified user interface device 168 positioned at a user's playing station in the gaming area 160. However, the functional modularity of the system facilitates the separation of the bet acceptance client 168*a* and the table presentation client 168*b* one from the other when desired.

The roulette betting system 100 supports players in a single player mode and in a multi-player mode. In the multi-player mode one or more casinos 140, 142 for wagering money or arcades 144 for recreational play subscribe to the modified electronic version of roulette offered by the gaming service 102. Each casino 140, 142 and arcade 144 have at least one electronic roulette gaming area 160, here pictorially represented as a network terminal. Preferably, as shown in FIG. 3, a gaming area 160 can be arranged as a "Queen Theater" so named in electronic roulette because of the way the seating is arranged. In the illustrated roulette gaming area 160, accommodations are present to facilitate hosting twenty-four players simultaneously. The central table 162 includes a draw presentation client 166, which provides the players with an electronic display of a roulette wheel. The central table 162 can accommodate eight players therearound wherein each player has a dedicated electronic interface 168 which includes modules comprising an interactive bet acceptance client 168*a* (FIG. 2) and a table presentation client 168*b* (FIG. 2) for inputting to the system the amount and type of bet the player wishes to make. Surrounding the central table 162 are a plurality of theater tables 164 wherein each theater table 164 can accommodate four players for the total of twenty-four players. Those practiced in the art will recognize that the number of players so accommodated is not limited to twenty-four, but rather is a function of the protocols utilized in the roulette betting system 100. User input and information presentation is separated into different clients or modules to adapt the system 100 to different hardware designs. Typically, the user input incorporates an input panel that may include physical buttons and an output system incorporating a display screen, audio outputs and lights. Those practiced in the art will recognize that the input and output functions can be incorporated in a single touch sensitive display for each player. These device functions are completely transparent and no hardware unique to the system 100 is required. The roulette gaming area 160 is communicative either directly or indirectly with the server system 110 of the central office 102 through an electronic communication link 124 via Internet 150. Alternatively, for a large casino 140, 142 or arcade 144, the roulette betting system 100 can be located within or dedicated to the casino 140, 142 or arcade 144 for the operation of multiple roulette gaming areas 160.

The roulette betting system 100 also supports players in a single player mode to enable a single player to participate in the modified electronic version of roulette presented by the gaming service central office 102. Single players 120 typically utilize a personal computer 122, which is communicatively interconnected to the Internet 150 by electronic communication links 124. Alternatively, the single players 120 can also communicate with the roulette system 100 via the Internet 150 utilizing a portable personal electronic device 123 and mobile electronic link 125 of dedicated communications network 126. The communications network 126 is further communicative with Internet 150 via the communications link 127. Those practiced in the art will readily recognize that while the personal electronic device 123 can be a smart phone, a personal digital assistant, a netbook, a laptop computer or other similar device currently available or available in the future that exhibits electronic communications abilities such as text messaging, email, internet access or other communication protocols. The personal computer 122 or personal electronic device 123 functions as the display client, input client, and output client for interactive player between the single player 120 and the roulette betting system 100.

As illustrated in FIG. 2, the server system 110 comprises a database server 111, which is the central element of the server system 110. The database server 111 stores persistent information and all connected modules fetch required information from the database server 111. The draw server 112 utilized a random number generator 113 to generate a random result within a given set of numbers. This resulting number is reprocessed using information about previous draws. The draw server 112 then passes the result to the draw presentation clients 166 and to the bet acceptance server 114. After passing the information to the bet acceptance server 114 new rules for the next draw are received. The bet acceptance server 114 receives bets from all connected bet acceptance clients 168*a*, verifies the input via interaction with the authentication/authorization server 116, and stores the bets. Information about the bets is returned to the bet acceptance client 168*a* and forwarded to the table management server 115. Depending on the state of the game, a request for a new 'result' is sent to the draw server 112 once the result of all pending bets have been received and processed and the result stored and forwarded to the bet acceptance clients 168*a* and the table management server 114. A new set of rules is then sent to the draw server 112. The backoffice 117, the agent web interface 118, the counter application 119, and the authentication/authorization server 116 are standard modules required to manage system 110 and are known in the industry. Further, the bet acceptance server 114, the table management server 115, the authentication/authorization server 116, the backoffice 117, the agent web interface 118, and the counter application 119, communicate with the database server 111 via a database interface.

Figure 4:
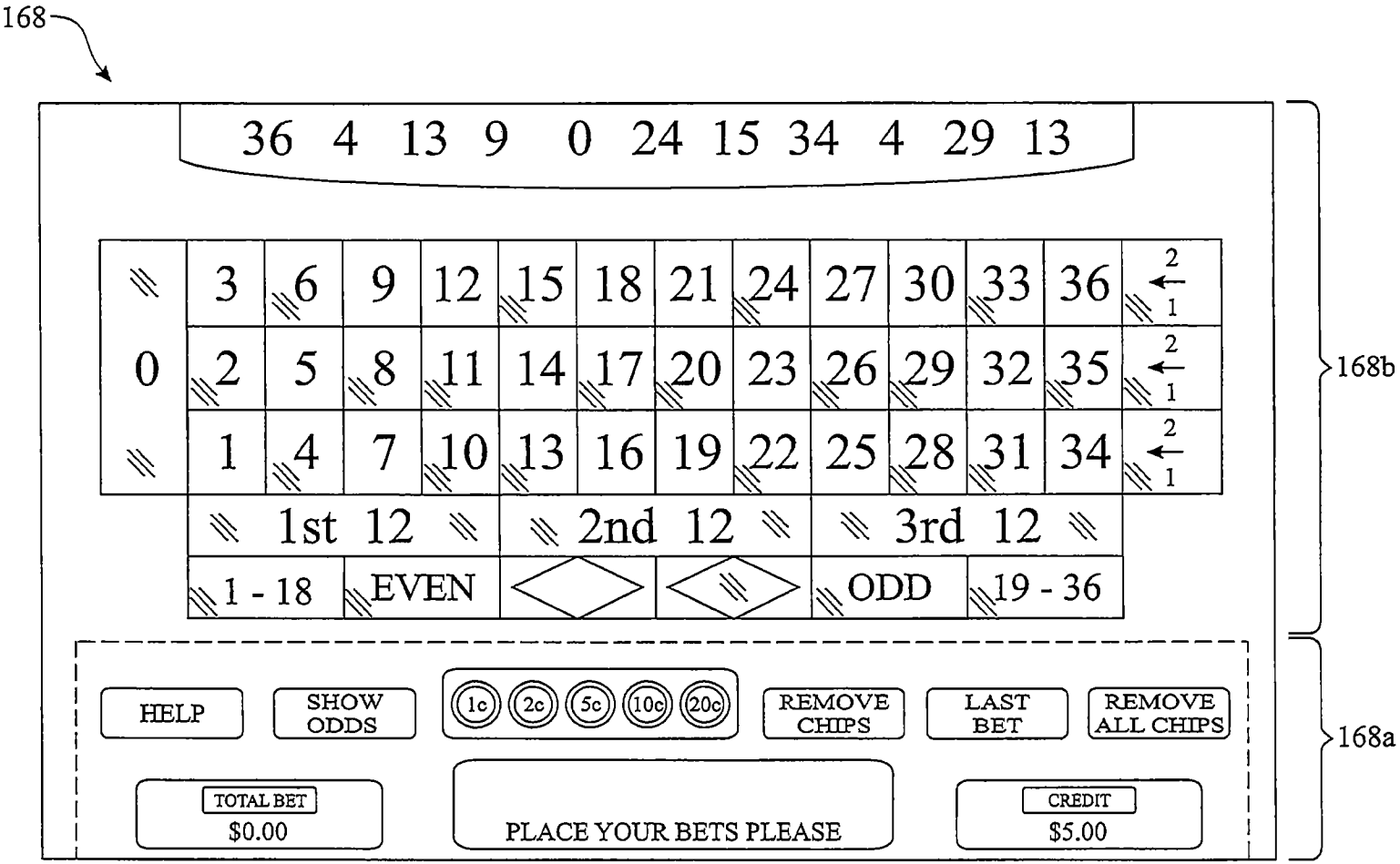
FIG. 4 presents a sample screen view of the betting table presentation and the bet acceptance module for the player interface.

A typical display output of a user interface device 168 is shown in FIG. 4. The lower portion of the display comprises a bet acceptance client 168*a* that incorporates a series of touch sensitive buttons on the screen to provide the user input for placing bets. The virtual buttons responsive to the touch of a user can include buttons to control the amount of bet to be placed, odds of winning a particular bet, the total bet placed, credit remaining in the user's stake, and buttons to control the placement/removal of chips. The upper portion of the display comprises a table presentation client 168*b* that is the graphical representation of the betting table and can graphically simulate a typical roulette betting table known in the industry. When in multi-player mode such as with the gaming area 160 in a casino 140, 142, or an arcade 144, each player receives information about bets of other players who are sharing the same table (gaming area 160). When in single player mode, only information about the player's own activity is displayed on the screen. Whether in multi-player mode or single player mode, the respective bets can be illustrated on the table presentation client display 168*b* in the form of virtual chips being placed on a typical roulette table.

The general concept of play for roulette system 100 is one where the user bets on the result of a spin of a roulette wheel with 'N' numbers. The probability that the result of the spin is a specific number is 1/N. When starting a new betting sequence, each field on the roulette wheel is a placeholder for a number in the range of 0 . . . (N−1). For each number in the result-set, a second property, that of "color", is added. The color property can be assigned to the number according to the color of the numbers on a roulette table. After the first spin of the wheel, the winning number is replaced in the betting table layout and is replaced by a randomly selected number out of the remaining (N−1) numbers. The second property (color) of the added number is inherited from the replaced number. Thereafter, the field of numbers on the betting table again contains "N" numbers for the next spin. However, the probability for the added number will be 2/N since the number occurs twice in the number field. Each occurrence of this number may have a different color property.

The sequence continues with a table field of N numbers, but after the first draw there will be multiple occurrences of one or more numbers and the odds for a single number will change depending on how often the number is used as a substitute for another withdrawn number. If in one of the subsequent spins a number with multiple occurrences in the table field is selected, all of the occurrences will be replaced by the same number selected from the field of available numbers. The probability of a number being used to replace the last selected number is also dependent on the number of occurrences in the number field. Each substitute number will inherit the color property from the block of the number it is replacing.

At the beginning of a betting sequence each number representing an entity in the number field is unique and therefore has a unique color attribute. As soon as there are multiple entities with the same number, they may have different color attributes. In these instances, bets on the number or on the number with a specific color attribute can be offered to the player. The availability of these bets depends on the layout of the gaming client 168 and may be random.

Figure 6:
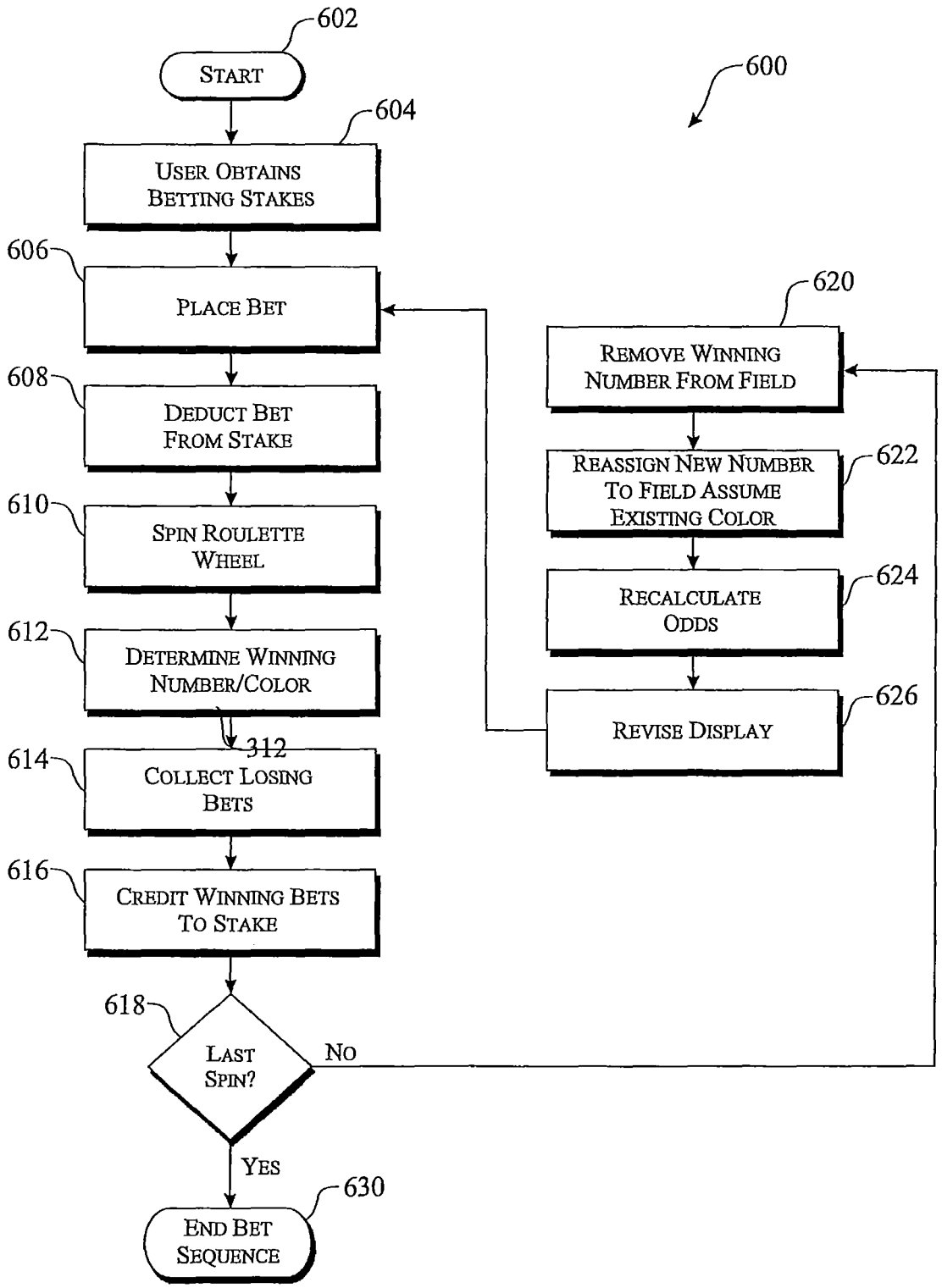
FIG. 6 presents a block diagram of a method for playing a modified electronic version of roulette.

A diagrammatic flow chart of a method 600 for playing an electronic modified version of roulette utilizing roulette betting system 100 is illustrated in FIG. 6. A betting sequence round of play is commenced in block 602 and in block 604 the user obtains a betting stake or credit for use during the betting sequence. Credit can be added to the user's account or stake is completely transparent and can be accomplished by adding cash in via BNA; by cash in via coin acceptors; by transferring money from an 'electronic purse'; or by 'remote in' from a counter. Other known methods of crediting a user's stake are anticipated and well known in the industry. Additionally, a remote user 120 playing in single mode on a personal electronic device 123 or home computer can establish and fund an account in methodologies well known in the industry.

For the remaining description of the modified roulette playing method 600, the description will be directed to a multiple player mode utilizing a gaming area 160 (FIG. 3) in a casino 140. In block 606 those users at the gaming area 160 utilize the bet acceptance client 168*a* of the dedicated user interface device 168 at their respective playing station at the center table 162 or the theater table 164 to place a desired bet on the virtual betting table of the table presentation client display 168*b*. Different bets can be placed such as inside bets on single numbers, split bets, neighbor bets, line bets or bets on simple chances are possible. The betting system 100 then automatically decrements their respective stakes by the amount of their bets in block 608. By utilizing the layout of a typical roulette betting table in the table presentation client display 168*b*.

Once the betting and account adjustments have been completed in blocks 606 and 608, the roulette wheel is 'spun' in block 610. The spinning of the roulette wheel is accomplished by the random number generator 113 selecting a random number and then associating the random number, through an internal algorithm, with a numbered slot on the roulette wheel representation on draw presentation client 166. The selected numbered slot corresponds to one of the numbered squares and color displayed on the betting table of table presentation client 168*b* in block 612. The system 100, then in block 614, determines those bets that are losing bets and collects those bets. In block 616, the system 100 then credits the winning bets to the user by incrementing the winnings to the user's stake. Once the bets have been reconciled for the prior spin, the system 100 determines, in block 618, whether the prior spin was the final spin of the betting sequence. If the prior spin was the final spin, the betting sequence ends in block 630 and a new betting sequence can then be started at block 602.

However, if the prior spin was not the final spin, the method proceeds to block 620 where the winning number is removed from the field of numbers on the roulette wheel displayed on draw presentation client 166 and on the betting table as displayed on the table presentation client 168*b*. The random number generator 113, in block 622, through an internal algorithm randomly selects a number from the remaining field of numbers and assigns the new number to the vacated number block while the block retains its original color. There will now be at least two instances of the new number present on the betting table as displayed on table presentation client 168*b*. As a result of the addition of the duplicated number, the odds each possible bet are recalculated in block 624, and the table layout of presentation client 168*b* is revised with the modified numbering and recalculated odds in block 626. The process then returns to block 606 for the placement of bets by the participating players. The cycle continues until in block 618 the system determines that a predetermined limit of number repetitions has occurred or after a predetermined number of betting cycles have occurred within the current betting sequence.

Figure 5:
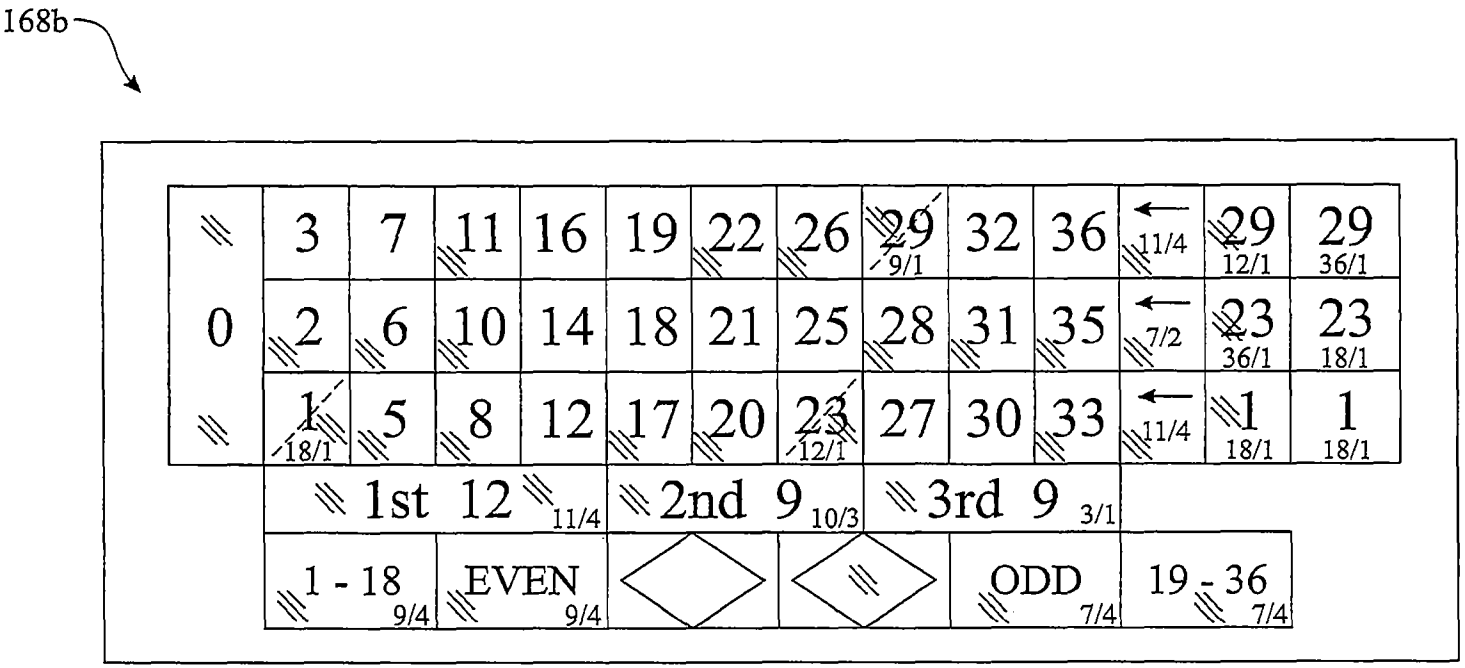
FIG. 5 presents a sample screen view of the modified betting table presentation after multiple cycles of betting with numbers of the betting field replaced.

Referring to FIG. 5, an example of a modified betting table layout display 168*b* is illustrated wherein the numbers 4, 9, 13, 15, 24, and 34 have been removed from play. These numbers have been replaced by additional instances of the numbers 1, 23, and 29. Further, the multiples of the added numbers are now associated with both colors and the new payoff odds are noted with each betting possibility.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

The invention claimed is:

1. A method of playing a modified electronic version of roulette on a system (100) having a central server system (110), a random number generator (113), and a database connected to an electronic network and at least one display for presenting to a player a draw presentation for displaying a representation of a roulette wheel, a table presentation display for displaying a representation of a roulette betting table, and a bet acceptance display for the player to place bets, said method including the steps of:

providing an executable instruction set hosted on the system (100); and executing a betting cycle including the steps of receiving from the bet acceptance display a bet desired by the player;

selecting a random number and associating the random number to one of a field of numbers presented on the table presentation display;

designating the associated one of the field of numbers as the winning number;

determining winning and losing bets;

removing the winning number from the field of numbers on the roulette betting table presented on the table presentation display;

replacing the removed number with a randomly selected one of the numbers remaining in the field of numbers on the roulette betting table presented on the table presentation display;

recalculating the odds of each possible bet; and repeating the betting cycle.

2. The method according to claim 1, wherein the server system (110) hosts the executable instruction set for playing the modified electronic version of roulette and wherein the server system (110) is connected to the Internet with a communications link (116) for communicating with entities outside of gaming service (102).

3. The method according to claim 1, wherein the system further comprises a bet acceptance client (168*a*) as an interface element enabling the player to place bets on the system (100).

4. The method according to claim 1, wherein the system (100) further comprises a table presentation client (168*b*) to provide the user with a graphical representation of a betting table.

5. The method according to claim 1, wherein the system is provided to playing roulette in a single-player mode or in a multi-player mode.

6. The method according to claim 5, wherein the system is provided to playing roulette in a multi-player mode wherein one or more casinos (140, 142) for wagering money or arcades (144) for recreational play subscribe to the modified electronic version of roulette offered by a gaming service (102).

7. The method according to claim 6, wherein the system comprises a central table (162) with a draw presentation client (166), which provides the players with an electronic display of a roulette wheel, wherein the central table (162) is adapted to accommodate multiple players wherein each player has a dedicated electronic interface (168) which includes modules comprising an interactive bet acceptance client (168*a*) and a table presentation client (168*b*) for inputting to the system the amount and type of bet the player wishes to make.

8. The method according to claim 5, wherein the system is provided to play roulette in a single-player mode wherein a single player (120) can communicate with the system (100) via Internet (150) utilizing a personal computer (122) or a portable personal electronic device (123) and/or mobile electronic link (125) of a dedicated communication network (126) and wherein on of these devices is used as the display client, input client, and output client for interactive player between the single player (120) and the system (100) for roulette betting.

9. The method according to claim 1, wherein the user bets on the result of a spin of a roulette wheel with 'N' numbers, wherein for each number in the result-set, a second property is added.

10. The method according to claim 1, wherein a user has a user account and the user obtains a betting stake or credit for use during the betting sequence and wherein the credit can be added to the user's account by the user.

11. The method according to claim 10, wherein the system (100) automatically decrements the respective stakes by the amount of the bets.

12. The method according to claim 10, wherein the system (100) determines those bets that are losing bets and collects those bets and then credits the winning bets to the user by incrementing the winnings to the user's stake.

13. The method according to claim 1, wherein the executing a betting cycle further comprises:

assigning a color property to each number in the field of numbers on the roulette betting table presented on the table presentation display;

assigning a number that is replacing the removed number with the same color property that was assigned to the removed number.

* * * * *